US006082916A

United States Patent [19]

Kageyama et al.

[11] Patent Number: 6,082,916

[45] **Date of Patent: *Jul. 4, 2000**

[54] MECHANICAL PENCIL

[75] Inventors: Hidehei Kageyama; Yoshihide Mitsuya, both of Kawagoe, Japan

[73] Assignee: Kotobuki & Co., Ltd., Japan

[ * ] Notice: This patent is subject to a terminal disclaimer.

[21] Appl. No.: 09/174,914

[22] Filed: Oct. 19, 1998

[30] Foreign Application Priority Data

Oct. 27, 1997 [JP] Japan ..... 9-309478

[51] Int. Cl.[7] ..... B43K 21/16

[52] U.S. Cl. ..... 401/65; 401/67

[58] Field of Search ..... 401/67, 65, 66, 401/55, 49, 57

[56] References Cited

U.S. PATENT DOCUMENTS 5,702,193 12/1997 Kageyama et al. ..... 401/65

FOREIGN PATENT DOCUMENTS

| | | | |
|---|---|---|---|
| 170153 | 7/1951 | Austria | 401/67 |
| 2319210 | 10/1974 | Germany | 401/67 |
| 9623666 | 8/1996 | WIPO | 401/65 |

*Primary Examiner*—David J. Walczak
*Attorney, Agent, or Firm*—Rothwell, Figg, Ernst & Manbeck, p.c.

[57] ABSTRACT

In a mechanical pencil capable of double-chuck and side-knock type lead control functions, a slide member is axially slidably fitted in a barrel fixedly provided at its front end with a head cap, a knocking member is pivotally supported in an opening formed in the barrel to operate the slide member so that a lead projecting back chuck on which a chuck ring is loosely fitted is advanced against the resilience of a chuck spring biasing the lead projecting back chuck backward to project a lead, a sleeve is fitted on the back chuck, an inner barrel is fitted on the sleeve, and a lead holding front chuck is placed in the head cap and is biased backward by a spring.

7 Claims, 5 Drawing Sheets

MECHANICAL PENCIL

BACKGROUND OF THE INVENTION

1. Field of the Invention

The present invention relates to a mechanical pencil provided with a double-chuck mechanism and a side-knock operating mechanism.

2. Description of the Related Art

Although there have been double-chuck mechanical pencils provided with double-chuck mechanisms, and side-knock type mechanical pencils provided with side-knock type lead control mechanisms, there has not been proposed any mechanical pencil provided with both a double-chuck mechanism and a side-knock operating mechanism. A double-chuck mechanical pencil provided with a front lead chuck and a back lead chuck, wherein a lead is adapted to be held by the front and back lead chucks, needs a turning motion inhibiting mechanism for inhibiting the front and back lead chucks from turning relative to each other because the lead is twisted and broken if either the front or the back lead chuck is turned.

A side-knock type mechanical pencil is provided with a side knock member which is moved along a slope, formed on a slide member, to project a lead. In the side-knock mechanical pencil, it is difficult to secure a space for a long stroke of the side knock member, and assembly is difficult and there is the possibility that an operation for knocking the side knock member cannot be properly achieved if the slide member turns relative to a barrel. Therefore, the side-knock mechanical pencil needs a turning motion inhibiting mechanism for inhibiting the slide member from turning. Accordingly, the use of a double-chuck mechanism and a side-knock type lead control mechanism in combination entails various technical problems and makes the construction of a mechanical pencil complex.

SUMMARY OF THE INVENTION

Accordingly, it is a first object of the present invention to provide a mechanical pencil provided with a double-chuck mechanism and a side-knock type lead control mechanism, and having a relatively simple construction.

A second object of the present invention is to provide a mechanical pencil provided with a double-chuck mechanism, a side-knock type lead control mechanism, and a turning motion inhibiting mechanism for inhibiting both the double-chuck mechanism and the side-knock type lead control mechanism from turning, capable of restraining a back lead chuck from turning to prevent twisting to break a lead held by the back lead chuck and a front lead chuck.

A third object of the present invention is to provide a mechanical pencil provided with a side-knock type lead control mechanism, and a turning motion inhibiting means formed between a slide member included in the side-knock type lead control means and the inner circumference of a barrel to inhibit the slide member from turning in order that the slide member can be easily fitted in its place and satisfactorily operated.

A fourth object of the present invention is to provide a mechanical pencil provided, in combination, with a side-knock type lead control mechanism having a side knock member and a double-chuck mechanism, and not requiring a long stroke of a side knock member for projecting the lead.

According to a first aspect of the present invention, a mechanical pencil comprises a double-chuck mechanism, a side-knock type lead control mechanism, and a turning motion inhibiting means for inhibiting both the double-chuck mechanism and the side-knock type lead control mechanism from turning.

According to a second aspect of the present invention, a mechanical pencil comprises a slide member slidably fitted in a barrel provided at its front end with a head cap, a knocking member pivotally supported in an opening formed in the barrel to operate the slide member so that a lead projecting back chuck on which a chuck ring is loosely fitted is advanced against the resilience of a chuck spring biasing the lead projecting back chuck backward to project a lead, an inner barrel fitted through a sleeve on the back chuck, and a lead holding front chuck placed in the head cap and biased by a spring.

DETAILED DESCRIPTION OF THE PREFERRED EMBODIMENT

A mechanical pencil in a preferred embodiment according to the present invention will be described hereinafter with reference to the accompanying drawings.

Referring to FIGS. 1 to 5, a side-knock operating mechanism and a double-chuck mechanism are built in a barrel 1. Reference will first be made to the side-knock type operating mechanism will be described. An elongated slide member 2 is axially slidably inserted in a substantially middle portion of the barrel 1. The slide member 2 comprises a slanted portion 2*c* having a surface 2*c*' that is angled relative to a longitudinal axis of the slide member 2, a lead passageway 2*b* extending through the slanted portion 2*c*, and a lead receiving portion 2*a* provided at a rear end of the lead passageway 2*b*. The lead receiving portion 2*a* has an outside diameter slightly smaller than the inside diameter of the barrel 1.

A chuck joint 3 extends forwardly from the front end of the lead passageway 2*b*. A back end portion of a back chuck 4 of the double-chuck mechanism is press-fitted in the chuck joint 3. The slanted portion 2*c* is provided on its opposite sides with first guide groove 2*d*. Similarly, the lead receiving portion 2*a* has second guide groove 2*d*' formed in opposite sides thereof. Axially extending guide ribs 1*a* (FIG. 4) formed on the inner surface of the barrel 1 are received in the first and second guide grooves 2*d*, 2*d*' to guide the slide member 2 for longitudinal sliding. The lead passageway 2*b* has a longitudinal bore 2*e* of a diameter great enough to allow at least one lead to be received therein. The slanted portion 2*c* is provided with a recess portion 2*f* for preventing the formation of shrinkage holes when molding the slide member 2 using resinous material.

Figure 1:
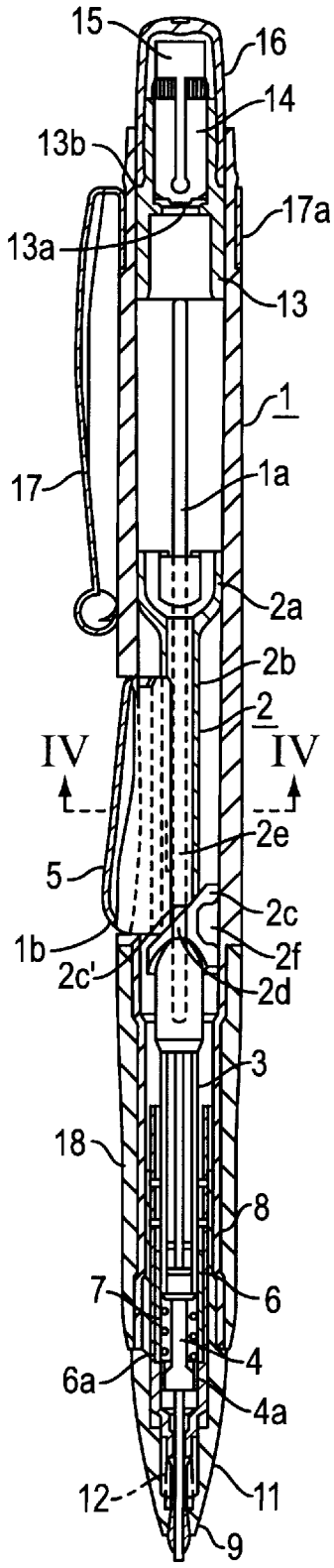
FIG. 1 is a longitudinal sectional view of a mechanical pencil in a preferred embodiment according to the present invention.
Figure 2:
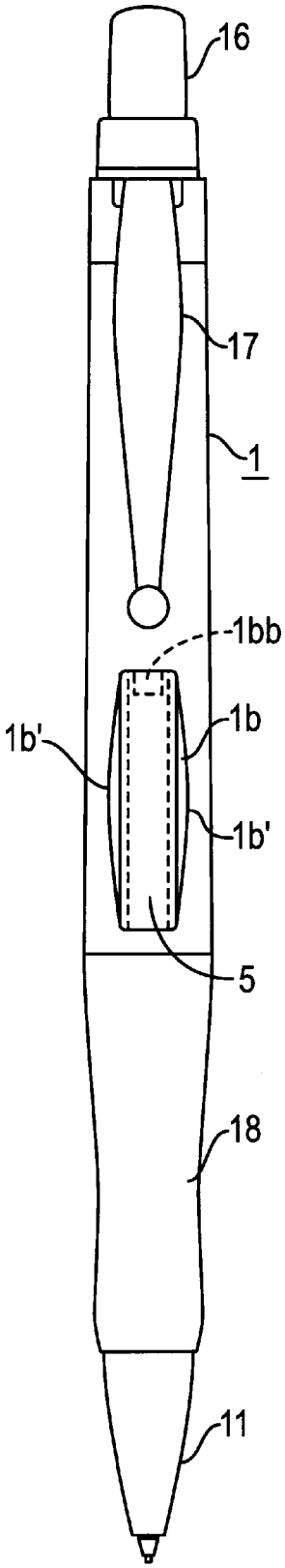
FIG. 2 is a front view of the mechanical pencil of FIG. 1.
Figure 3:
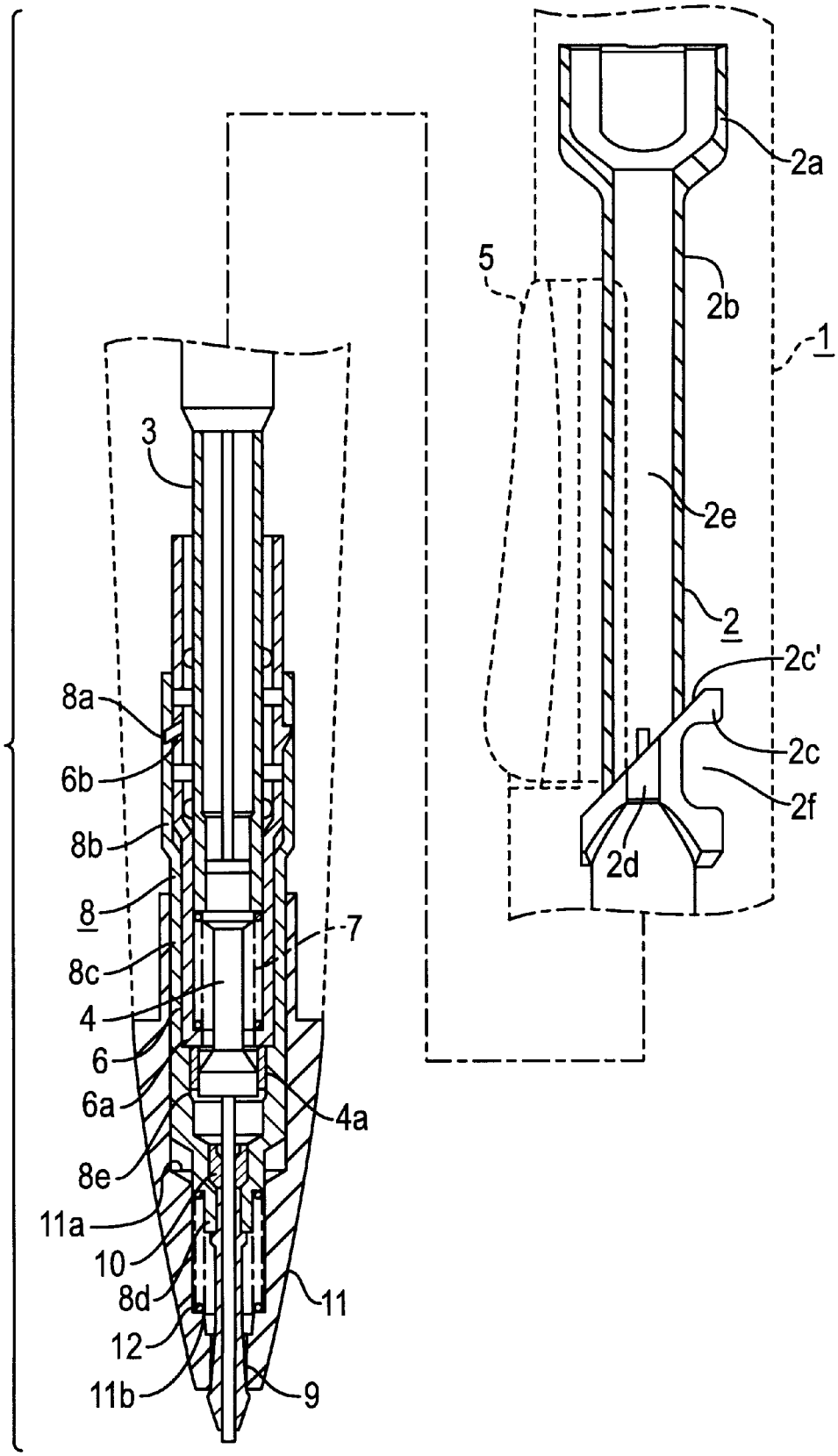
FIG. 3 is an enlarged, longitudinal sectional view of the mechanical pencil of FIG. 1.
Figure 4:
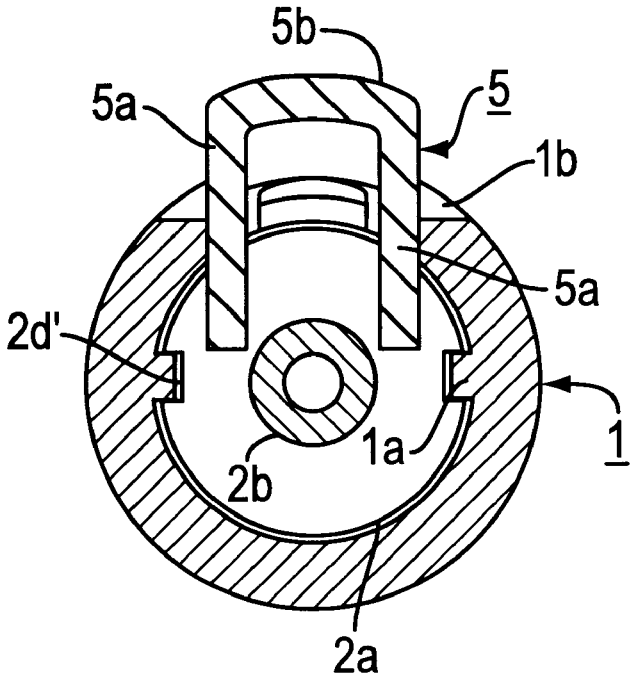
FIG. 4 is an enlarged sectional view taken on line A—A in FIG. 1.
Figure 5:
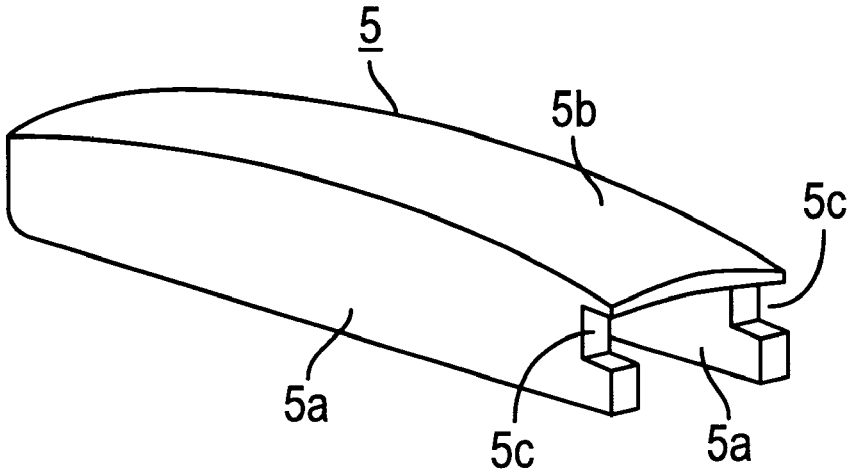
FIG. 5 is a perspective view of a side-knock member provided in the mechanical pencil of FIG. 1.

The barrel 1 has an opening 1*b* formed in a side thereof. As shown in FIG. 2, the opening 1*b* has a pair of spaced apart recess portions 1*b*' which extend rearwardly from a rear end edge of the opening 1*b*, and a supporting piece 1*bb* interposed between the pair of spaced apart recess portions 1*b*'. The supporting piece 1*bb* projects into the opening 1*b* from the rear end edge of the opening 1*b*. A side knocking member 5 is received in the opening 1*b*. More particularly, the side knocking member 5 comprises a body having a substantially streamline-shape in outline and a substantially inverted U-shape in cross-section as best shown in FIGS. 4 and 5. The body of the side knocking member 5 comprises both side sections 5*a* and an intermediate section 5*b* interconnecting the both side sections 5*a*. The both side sections 5*a* are formed with notches 5*c* at rear end edges thereof. The side knocking member 5 is received in the opening 1*b* with the notches 5*c* thereof receiving rear edges of the recess portions 1*b*' of the opening 1*b*, with a rear end portion of the intermediate section 5*b* being put on the supporting piece 1*bb* of the opening 1*b*, and with lower surfaces of front regions of the both side sections 5*a* being in contact with the surface 2*c*' of the slanted portion 2*c* of the slide member 2. Thus, the side knocking member 5 is pivotally supported to the barrel 1 in a manner to be pivoted about the supporting piece 1*b*' of the opening 1*b*.

The double-chuck mechanism will be described hereinafter. The back chuck 4 serving as means to advance a lead is fixed to the chuck joint 3. A chuck ring 4*a* is loosely fitted on the front end portion of the back chuck 4. When an assembly comprising the back chuck 4 and slide member 2 is advanced by knocking operation as will be described hereinafter in detail, the chuck ring 4*a* comes into contact with a step 8*e* formed in the inner circumference of an inner barrel 8 and is separated from the back chuck 4. The back chuck 4 is enclosed by a sleeve 6 provided at its front end with an inwardly projecting flange 6*a*.

A chuck spring 7 is disposed between the flange 6*a* and a front end of the joint 3 to bias the assembly comprising the back chuck 4 and slide member 2 backward. Incidentally, the side knocking member 5 is received in the opening 1*b* of the barrel 1 with an upper area thereof protruding from the outer circumference of the barrel 1 in order that an user can depress the side knocking member 5 to advance the assembly comprising the back chuck 4 and slide member 2.

The inner barrel 8 is fitted on the sleeve 6, and a projection 6*b* of the sleeve 6 is fitted in a hole 8*a* formed in the inner barrel 8 to combine the sleeve 6 and the inner barrel 8 in a unit. The inner barrel 8 has a back section 8*b* of a relatively great diameter provided with the hole 8*a*, a middle section 8*c*, and a front section 8*d* of a relatively small diameter. A rear end portion of a lead holding front chuck 9 is fixedly pressed in the front end section 8*d* of the inner barrel 8.

The inside diameter of a front end portion of the middle section 8*c* is reduced to form the same front portion in an increased wall thickness. An annular packing 10 (FIG. 3) of rubber or the like for holding a lead is fitted in the front end portion of the middle section 8*c* of the inner barrel 8.

A front end portion of the barrel 1 is provided with a female thread, and a rear end portion of a head cap 11 provided with a male thread is screwed in the front end portion of the barrel 1. A first step 11*a* is formed on the inner circumference of the head cap 11 and a second step 11*b* is formed in front of the first step 11*a* on the inner circumference of the head cap 11. A spring 12 is extended between the second step 11*b* and the front end of the inner barrel 8 to bias the front chuck 9, the inner barrel 8 and the sleeve 6 backward. The front chuck 9 needs to exert a holding force necessary only for restraining a lead from free movement on the lead.

An eraser holding tube 13 is detachably fitted in the back end portion of the barrel 1. The eraser holding tube 13 has a partition wall 13*b* provided with an opening 13*a* through which leads are supplied into the slide member 2. An eraser 15 coated with a metal jacket 14 is fitted in a back portion of the eraser holding tube 13 behind the partition wall 13*b*.

A back end cap 16 is put on the reduced back portion of the eraser holding tube 13 in an annular space between the back portion of the eraser holding tube 13 and the back end portion of the barrel 1. A clip 17 having an annular clasp 17*a* is put on the back end portion of the barrel 1. An elastic tubular coating 18 is fitted on a front portion of the barrel 1.

The operation of the mechanical pencil in this embodiment will be explained hereinafter. When writing with the mechanical pencil loaded with leads, the side knocking member 5 is depressed with a finger tip. Then, the front end of the side walls 5*b* of the knocking member 5 in contact with the inclined cam surface of the cam section 2*c* of the slide member 2 move down pushing the slide member 2 forward against the force of the spring 7 biasing the slide member 2 backward to advance the back chuck 4.

As the back chuck 4 is advanced together with the chuck ring 4*a* loosely fitted thereon, the chuck ring 4*a* comes into contact with the step 8*e* formed on the inner circumference of the inner barrel 8 and is restrained from further advancement, and only the back chuck 4 holding a lead is advanced further. Then, the force exerted on the knocking member 5 to advance the back chuck 4 is removed from the knocking member 5 to allow the back chuck 4 to be retracted by the spring 7, leaving the lead at an advanced position. As the back chuck 4 is retracted, the chuck ring 4*a* engages again with the back chuck 4, so that the back chuck 4 chucks the lead again and the back chuck 4 chucking the lead is retracted further. Consequently, the lead is advanced by a distance corresponding to an effective forward stroke of the back chuck 4.

The knocking member 5 is thus knocked several times to project a necessary length of the lead from the tip of the front chuck 9 and the lead is held with a portion thereof projected from the tip of the front chuck 9 for writing. After completing writing, the knocking member 5 is depressed to release the lead from the back chuck 4 and the tip of the lead is pressed lightly against a paper sheet or is pushed lightly by the finger tip to push back the projecting portion of the lead into the head cap 11.

While the lead is held by the lead projecting back chuck 4 and the lead holding front chuck 9, the back chuck 4 is restrained from turning by the slide member 2 which in turn is restrained from turning by the longitudinal guide ribs la formed on the inner circumference of the barrel 1 and received in the guide grooves 2*d* of the slide member 2, Therefore, the lead is never twisted to break by the back chuck 4.

Since the depression of the knocking member 5 is converted effectively into the forward movement of the back chuck 4, the stroke of the knocking member 5 need not be very great.

Figure 6:
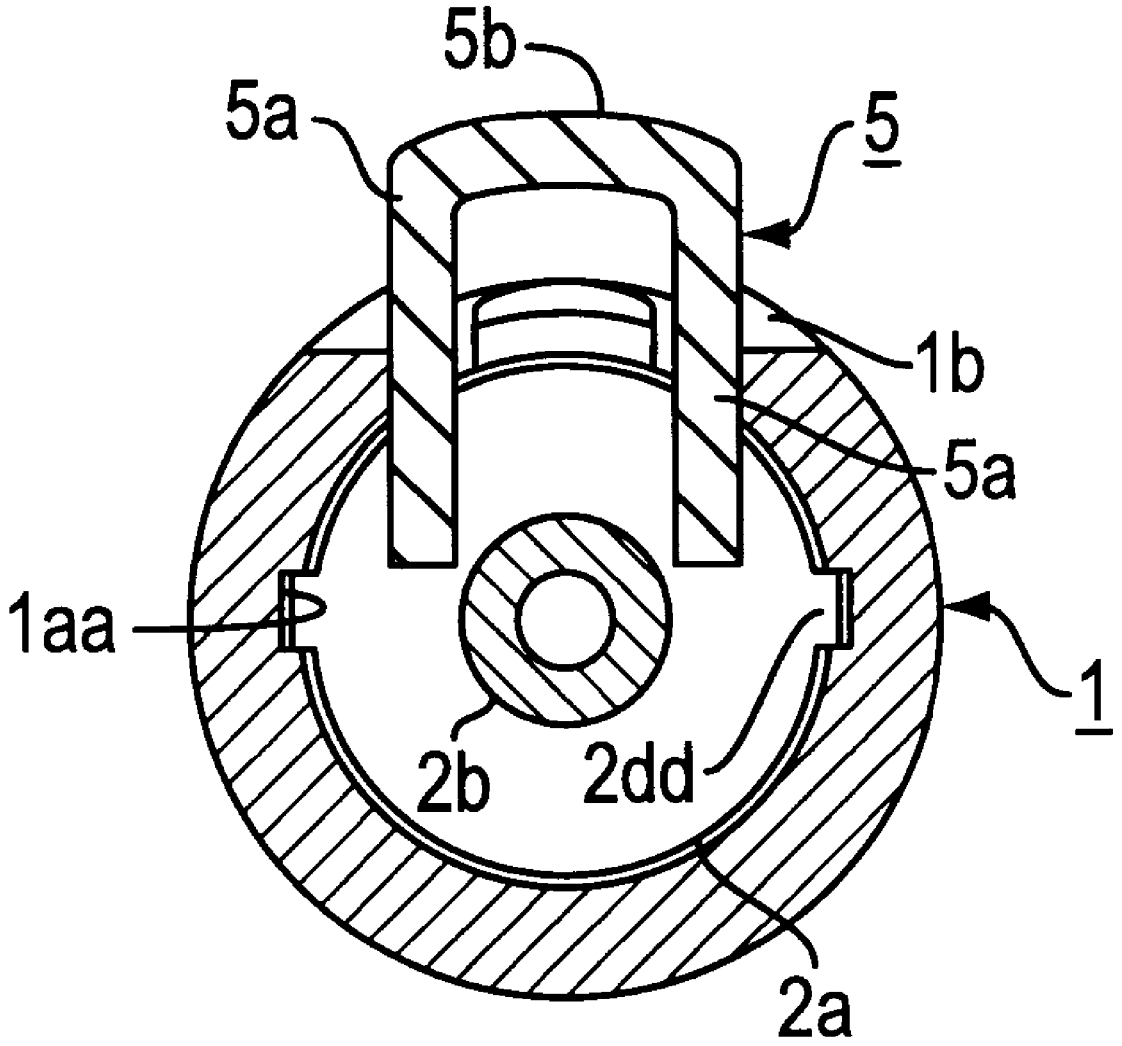
FIG. 6 is an enlarged sectional view taken along line A—A in FIG. 1 of an alternative embodiment according to the present invention.

Although the turning motion inhibiting means comprises the longitudinal guide grooves 2*d* formed in the cam section 2*c* of the slide member 2 and the longitudinal guide ribs 1*a* formed on the inner circumference of the barrel 1 in the embodiment described herein, 1*aa* the turning motion inhibiting means may comprise longitudinal guide grooves formed in the inner circumference of the barrel 1 and longitudinal ribs 2*dd* formed on the outer surface of the cam section 2*c* of the slide member 2 as shown in FIG. 6.

Naturally, the guide ribs and the guide grooves of the turning motion inhibiting means may be formed at any corresponding sections of the outer surface of the slide member 2 and the inner circumference of the barrel 1.

What is claimed is:

1. A mechanical pencil comprising:

a barrel having an opening formed in a side portion thereof;

a head cap attached to the front end of the barrel, the head cap having a center bore;

a slider axially slidably fitted in the barrel;

a chuck joint connected to the slider;

a back chuck fixedly connected to the chuck joint for propelling a lead, a chuck ring loosely fitted on the back chuck;

a back chuck biasing spring that has resilience and biases the back chuck backwards;

a side-knocking member being pivotally supported in the opening of the barrel for advancing an assembly, which comprises the slider, the chuck joint and the back chuck, against the resilience of the back chuck biasing spring to cause the lead to be projected out of the head cap;

a front chuck axially slidably fitted in the center bore of the head cap for holding the lead;

a front chuck biasing spring extended in the head cap to bias the front chuck backward; and a turning motions inhibiting means formed between the slider and the barrel for inhibiting the turning of the slider relative to the barrel.

2. The mechanical pencil according to claim 1, wherein the turning motion inhibiting means comprises longitudinal guide ribs formed on an outer surface of the slider and longitudinal guide grooves formed at an inner surface of the barrel.

3. The mechanical pencil according to claim 1, wherein the turning motion inhibiting means comprises longitudinal guide grooves formed in an outer surface of the slider and longitudinal guide ribs formed at an inner surface of the barrel.

4. The mechanical pencil according to claim 3, wherein the guide grooves of the turning motion inhibiting means are formed at an outer surface of a front cam section of the slider.

5. The mechanical pencil according to claim 4, wherein the slider comprises a slant portion having a surface that is angled relative to a longitudinal axis of the slider, a lead passageway extending through the slanted portion, and a lead receiving portion provided at a rear end of the lead passageway and having an outside diameter slightly smaller than the inside diameter of the barrel.

6. The mechanical pencil according to claim 5, wherein the slant portion is provided with a recess portion for preventing the formation of shrinkage holes when molding the slider using resinous material.

7. The mechanical pencil according to claim 3, wherein the longitudinal guide grooves extend a substantial length of the barrel.

* * * * *